US007370384B2

(12) United States Patent
Miller et al.

(10) Patent No.: US 7,370,384 B2
(45) Date of Patent: May 13, 2008

(54) COMBINATION WEDGE AND NOTCH TROWEL WITH REVERSIBLE GRIP HANDLE

(75) Inventors: Jon B. Miller, Fullerton, CA (US); Norman L. Hill, Riverside, CA (US); Mark A. Longfellow, Foothill Ranch, CA (US); Norman C. Tracy, Huntington Beach, CA (US); Thomas Nieto, Fullerton, CA (US)

(73) Assignee: Custom Building Products, Inc., Seal Beach, CA (US)

( * ) Notice: Subject to any disclaimer, the term of this patent is extended or adjusted under 35 U.S.C. 154(b) by 359 days.

(21) Appl. No.: 11/046,134

(22) Filed: Jan. 27, 2005

(65) Prior Publication Data

US 2006/0162111 A1 Jul. 27, 2006

(51) Int. Cl.
*B05C 17/10* (2006.01)

(52) U.S. Cl. ..... 15/236.08; 15/235.4; 30/355; 30/169; D8/45; D32/46

(58) Field of Classification Search ..... 15/235.6, 15/235.4, 236.08; 427/277, 355–356, 369; D8/45; 30/351, 355–357, 169, 230, 260; D32/40, 46; 16/436
See application file for complete search history.

(56) References Cited

U.S. PATENT DOCUMENTS 2,076,836 A * 4/1937 Goldblatt ..... 16/110.1
2,338,007 A * 12/1943 Morris ..... 30/351
2,799,930 A * 7/1957 Champlin ..... 30/355
4,884,312 A * 12/1989 Clark ..... 15/235.4
5,231,729 A 8/1993 Rose
5,522,111 A * 6/1996 Kelsay et al. ..... 15/235.4
6,178,586 B1 1/2001 Jafarmadar
6,205,610 B1 3/2001 Westthorp
6,223,384 B1 * 5/2001 Kuhlen ..... 15/235.4

FOREIGN PATENT DOCUMENTS

GB 2219620 A * 12/1989
GB 2 259 938 A 3/1993

OTHER PUBLICATIONS

Internet printout re European Tile Masters, 1Y- Euro Notch Trowel and 2Y- Euro Angle Trowel, pp. 22-23, Mar. 1, 2004.
Superior Bilt catalog, pp. 22-23 plus front and back pages of the catalog (© 2003).

* cited by examiner

*Primary Examiner*—Shay L Karls
(74) *Attorney, Agent, or Firm*—Fulwider Patton LLP

(57) ABSTRACT

The combination wedge and notch trowel includes a reversible grip handle and an integrated wedge, for applying cement or adhesive to a substrate surface for installation of tiles. The ergonomically contoured reversible handle allows a user to use the notch trowel in a forward or backwards position with the same hand. The blade portion includes a notch pattern of conically shaped trapezoidal notches and large parabolic notches. The integrated wedge allows a user to use the wedge side of the trowel to pry up and remove tiles.

17 Claims, 6 Drawing Sheets

COMBINATION WEDGE AND NOTCH TROWEL WITH REVERSIBLE GRIP HANDLE

BACKGROUND OF THE INVENTION

1. Field of the Invention

This invention relates generally to trowels for use in spreading of a cement or adhesive on a substrate surface for the laying of tiles on the substrate surface, and more particularly relates to a notch trowel having a substantially rigid trowel blade portion with a peripheral blade edge having a notch pattern providing improved contact between the cement or adhesive and applied tiles, a wedge member or shank for prying up tiles to be removed, and an ergonomic reversible grip handle used to manually grasp the notch trowel.

2. General Background and State of the Art

Trowels are commonly used for spreading cement or adhesive for installation of tiles on a substrate surface such as a wall or floor. Such trowels typically have a generally flat blade portion for spreading and smoothing the cement or adhesive, and a handle connected to the blade portion. Such trowels are also commonly used to pry up tiles to be removed, which can bend and otherwise damage the trowel to such an extent that the trowel can become unusable for spreading cement.

One conventional trowel is known having a blade that includes two adjoining edges having multiple notches, for spreading cementitious material, and a third edge that includes a rectangular extension of the blade for use as a margin trowel for prying up tiles. The trowel also includes a tubular handle rigidly attached to the trowel body.

Conventional notch trowels have used patterns of notches having square, rounded, saber tooth, and triangular shapes, as well as rounded shapes with obliquely angled sides flaring outwardly and inwardly. One conventional adhesive trowel has a blade edge with large notches, and small notches interspaced between the large notches. It has been found that spreading of cement or adhesive with a trowel having square notches or round notches commonly forms air bubbles in the cement or adhesive, interfering with optimal contact of the cement or adhesive with applied tiles, requiring application of heavy pressures to improve the degree of contact to an acceptable amount. For example, without application of pressure to applied tiles, such notch trowels commonly provide a contact spread with the tiles of only about 50%, indicating that approximately half of the surface of the applied tiles faces a space left between ridges of the cement or adhesive. In order to achieve a greater contact spread of 80%, which is considered to be the industry standard, it is commonly necessary to apply heavy pressures to tile applied to a cement or adhesive spread on a substrate surface, which can cause the contact spread to be inconsistent. It would be desirable to provide a notch pattern that can achieve a greater contact spread of 80%, without the application of heavy pressures, and with improved consistency.

It is also often necessary to turn a trowel around to use the trowel backwards to use a smooth flat side of a trowel to fill in pores or spaces in spreading cement based adhesive. This can be accomplished by switching from using the dominant hand to the non-dominant hand in using the trowel, i.e. using the trowel with both the left and right hands for the different directions of use of the trowel, but this can be awkward for users who are not ambidextrous. For trowels with a conventional short cylindrical configuration with a relatively thin rod connecting the handle to the blade portion of a trowel, using the trowel forwards and backwards with the same hand can be awkward. Although trowels having a handle with a "D" shaped configuration allow the trowel to be more easily reversible for use with a dominant hand, this type of handle is commonly centered on the blade of the trowel, making use of the trowel equally awkward forwards and backwards, with either hand.

It would be desirable to provide a notch trowel with a wedge on one side of the trowel allowing a user to use the wedge side of the trowel as a margin trowel to pry up tiles. It would also be desirable to provide a notch trowel with a notch pattern with conically shaped trapezoidal and parabolic notches with non-parallel sides to produce improved suction of the notches over the cement or adhesive to be spread, and that provides an improved, more consistent contact spread of cement or adhesive. It would also be desirable to provide a notch trowel with an ergonomic reversible handle with a rounded shoulder and thinner neck portion, allowing users to more easily turn the trowel around to use the trowel backwards with a dominant hand. The present invention satisfies these and other needs.

INVENTION SUMMARY

Briefly, and in general terms, the invention provides for a notch trowel with a reversible grip handle and an integrated wedge, for applying cement or adhesive to a substrate surface for installation of tiles. The notch trowel includes an ergonomically contoured reversible handle that allows a user to use the notch trowel in a forward or backwards position with the same hand to spread the cement or adhesive over a substrate surface for installation of tile. The blade portion of the notch trowel includes a series of notches on a long side and a short side of the blade edge with a notch pattern of conically shaped trapezoidal and parabolic notches with non-parallel sides to produce improved suction of the notches over the cement or adhesive to be spread, and that provides an improved, more consistent contact spread pattern of cement or adhesive. The integrated wedge of the notch trowel is provided on one side of the trowel to allow a user to use the wedge side of the trowel to pry up tiles.

The present invention accordingly provides for a notch trowel for spreading cement or adhesive over a substrate surface for the installation and removal of tiles, the notch trowel including a substantially rigid trowel blade portion having a flat bottom surface and a peripheral blade edge with a smooth side and a series of notches formed in the peripheral blade edge along one or more other sides of the blade edge. In one presently preferred aspect, the notch trowel includes a wedge member mounted to the blade portion. The wedge member has an elongated flattened rectangular wedge main body portion and a beveled wedge portion tapering from the main body portion to a narrowed rear edge portion abutting the smooth side of the peripheral blade edge. The wedge member thus can be placed under an edge of a tile to be removed, and can be used to pry up the tile without bending or otherwise damaging the blade portion of the trowel. The notch trowel also includes a handle mounted to the blade portion for manually grasping and manipulating the notch trowel.

In a presently preferred aspect, the wedge member is formed of hollow cast aluminum. In another presently preferred aspect, the wedge member is mounted to blade portion by an adhesive. The handle includes a base support portion that may be mounted to the wedge member.

In another presently preferred aspect of the invention, the handle is an ergonomic reversible grip handle, including a cylindrical main body formed by a grip portion and a handle support member. The handle support member has an S-shaped curved configuration with an upper support portion connected to the grip portion, a middle neck portion having a curvature tapering from the upper support portion to a base support portion connected to the blade portion, wherein the handle support member curves from the base support portion to extend over the wedge member toward the smooth side abutting the narrowed rear edge portion of the wedge member. In another presently preferred aspect, the grip portion extends over half of the length of the blade portion. In another aspect, the ergonomic reversible grip handle includes a joint interfacing between the grip portion and handle support member. The grip portion currently preferably has a rounded butt end, which may be formed by a rounded end cap.

In a presently preferred aspect, the peripheral blade edge comprises a notched long side, an adjacent notched short side, a smooth long side opposing the notched long side, and a smooth short side opposing the notched short side. In another presently preferred aspect of the notch trowel of the invention, the plurality of notches include a plurality of first short trapezoidal notches, a plurality of second large parabolic notches interspersed among the short trapezoidal notches, and a plurality of third intermediate size trapezoidal notches interspersed among the plurality of first short trapezoidal notches and the plurality of second large parabolic notches. The plurality of second large parabolic notches preferably extend into the blade edge to a greater depth than the first short trapezoidal notches, and the plurality of third intermediate size trapezoidal notches preferably extend into the blade edge to a greater depth than the large parabolic notches. The notches advantageously have conically configured first and second side edges that are oblique to a corresponding side of the blade edge.

Other features and advantages of the present invention will become more apparent from the following detailed description of the preferred embodiments in conjunction with the accompanying drawings, which illustrate, by way of example, the operation of the invention.

DETAILED DESCRIPTION OF PREFERRED EMBODIMENTS

Figure 1:
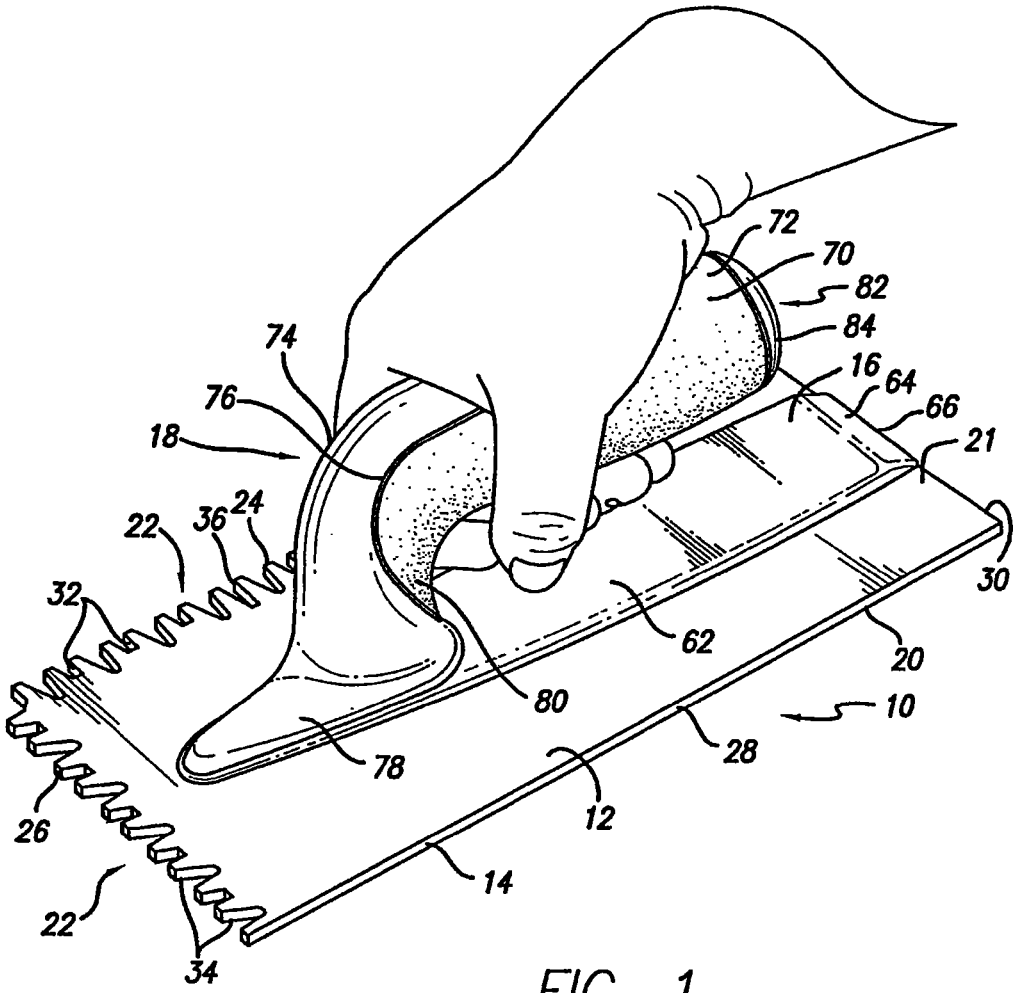
FIG. 1 is a perspective view of the combination wedge and notch trowel with reversible grip handle, according to the present invention, showing the handle gripped by a user in a forward position with a right hand.

Referring to the drawings, which are provided for purposes of illustration and by way of example, the present invention provides for notch trowel 10 for spreading cement or adhesive over a substrate surface, such as a floor or a wall, for the installation of tile for example. As is illustrated in FIG. 1, the notch trowel includes a substantially rigid trowel blade portion 12 with a peripheral blade edge 14, a wedge member or shank 16 mounted to an upper surface of the blade portion, and an ergonomic reversible grip handle 18 used to manually grasp the notch trowel, shown gripped by a user in a forward position with a right hand in FIG. 1. The blade portion is typically rectangular in shape, having a flat bottom surface 20, an upper surface 21, and a series of notches 22 having a desired shape or shapes in a desired pattern along at least one side of the blade edge. Other shapes of the blade portion may also be suitable, such as square, triangular, tear drop, or the like. In a presently preferred aspect, the peripheral edge of the blade portion has a notched long side 24, an adjacent notched short side 26, a smooth long side 28 opposing the notched long side, and a smooth short side 30 opposing the notched short side. The blade portion is typically made of a metal, such as stainless steel, for example.

In a presently preferred embodiment, the series of notches formed on the notched sides of the blade portion are formed in a notch pattern that has been found to be particularly suitable in forming a pattern of ridges and valleys in cement or adhesive spread over a substrate surface, such as a floor or wall, for example, that provides a desired contact spread of the cement or adhesive when a tile is applied over the cement or adhesive spread with the notch trowel. Referring to FIGS. 1-4, the notch pattern preferably includes a plurality of first short trapezoidal notches 32, a plurality of second large parabolic notches 34, and a plurality of third intermediate size trapezoidal notches 36. Referring to FIG. 4, in a presently preferred aspect, the short trapezoidal notches have a wide opening or mouth portion 38 typically about 0.250 inches across, a narrower opposing closed end portion 40 typically about 0.083 to 0.166 inches long, and a first side edge 42 and second side edge 44 that are oblique to the corresponding side of the blade edge extending into the blade edge to a first short depth, which is typically about 0.225 to 0.375 inches.

The large parabolic notches are preferably interspersed among the short trapezoidal notches, and have a relatively large opening or mouth portion 46 typically about 0.375 inches across an opposing closed rounded end portion 48, a first side edge 50, and a second side edge 52 that are oblique to the corresponding side of the blade edge and that extend into the blade edge to a second depth greater than the depth of the short trapezoidal notches. The large parabolic notches typically extend to a depth of about 0.375 to 0.5 inches.

The intermediate size trapezoidal notches, which are interspersed among the other notches, and are smaller than the larger parabolic notches, typically have a opening or mouth portion 54 equal to the opening or mouth portion of the short trapezoidal notches, typically about 0.250 inches across, a narrower opposing closed end portion 56, typically about 0.098 to 0.101 inches long, a first side edge 58, and a second side edge 60 that are oblique to the corresponding side of the blade edge. The intermediate size trapezoidal notches preferably extend into the blade edge to a longer depth than the depth of the large parabolic notches. The intermediate size trapezoidal notches typically extend into the blade edge about 0.406 to 0.656 inches. The depth of the intermediate size trapezoidal notches is typically about 0.031 inches greater than the depth of the large parabolic notches The notched sides of the notch trowel are used to apply and spread the cement based adhesive to provide a series of ridges and valleys with desired spacing between the ridges of cement based adhesive laid down on the substrate surface, for achieving a desired degree of contact of the cement based adhesive with the tiles placed over the cement based adhesive when the cement based adhesive spreads under pressure applied to the tiles.

Figure 2:
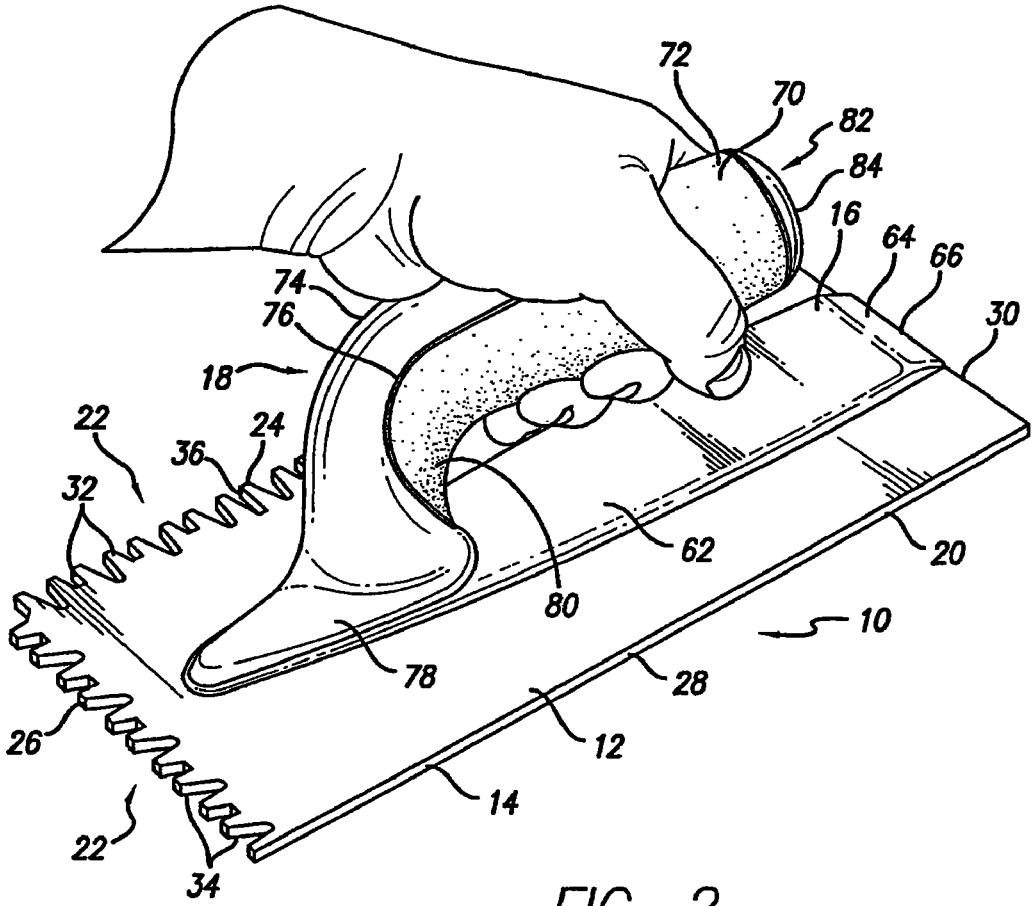
FIG. 2 is a perspective view of the combination wedge and notch trowel with reversible grip handle of FIG. 1, showing the handle gripped by a user in a reversed position with a left hand.
Figure 3:
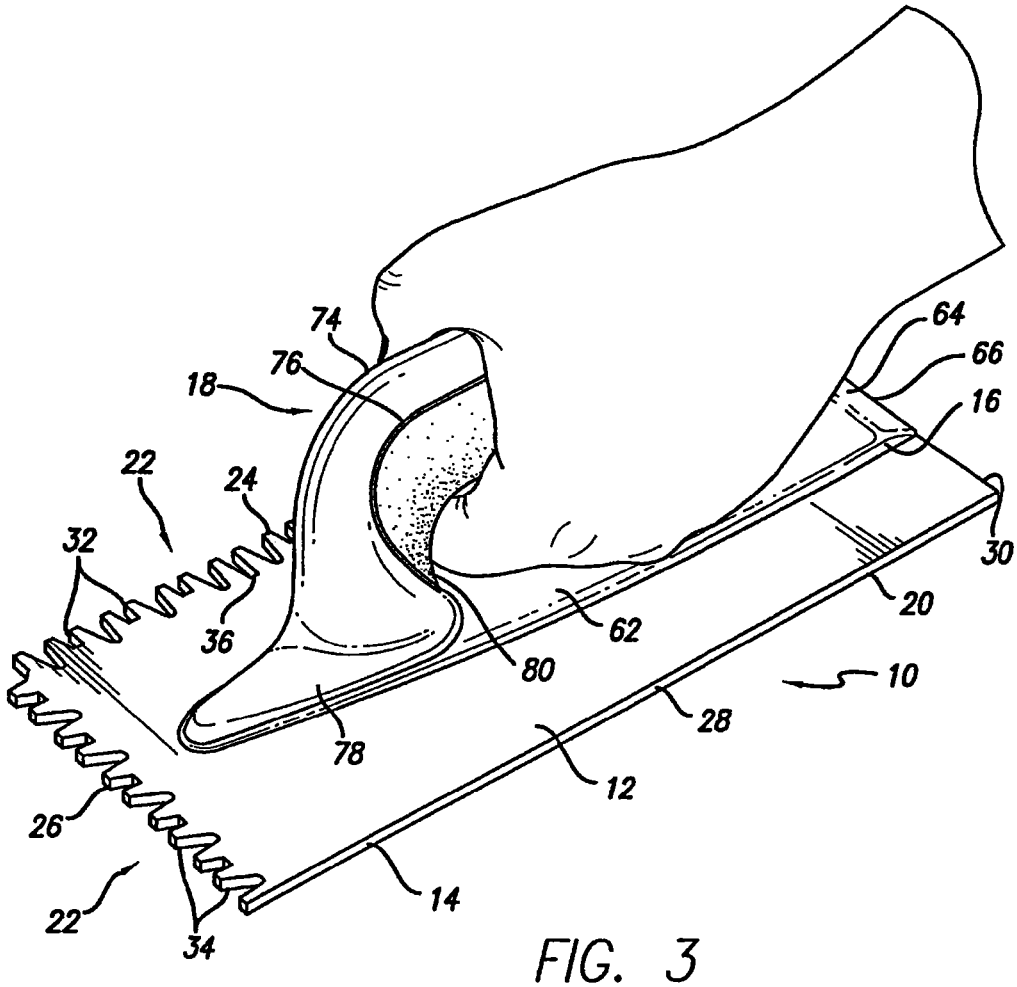
FIG. 3 is a perspective view of the combination wedge and notch trowel with reversible grip handle of FIG. 1, showing the handle gripped by a user in an alternate grip in a forward position with the right hand.
Figure 4:
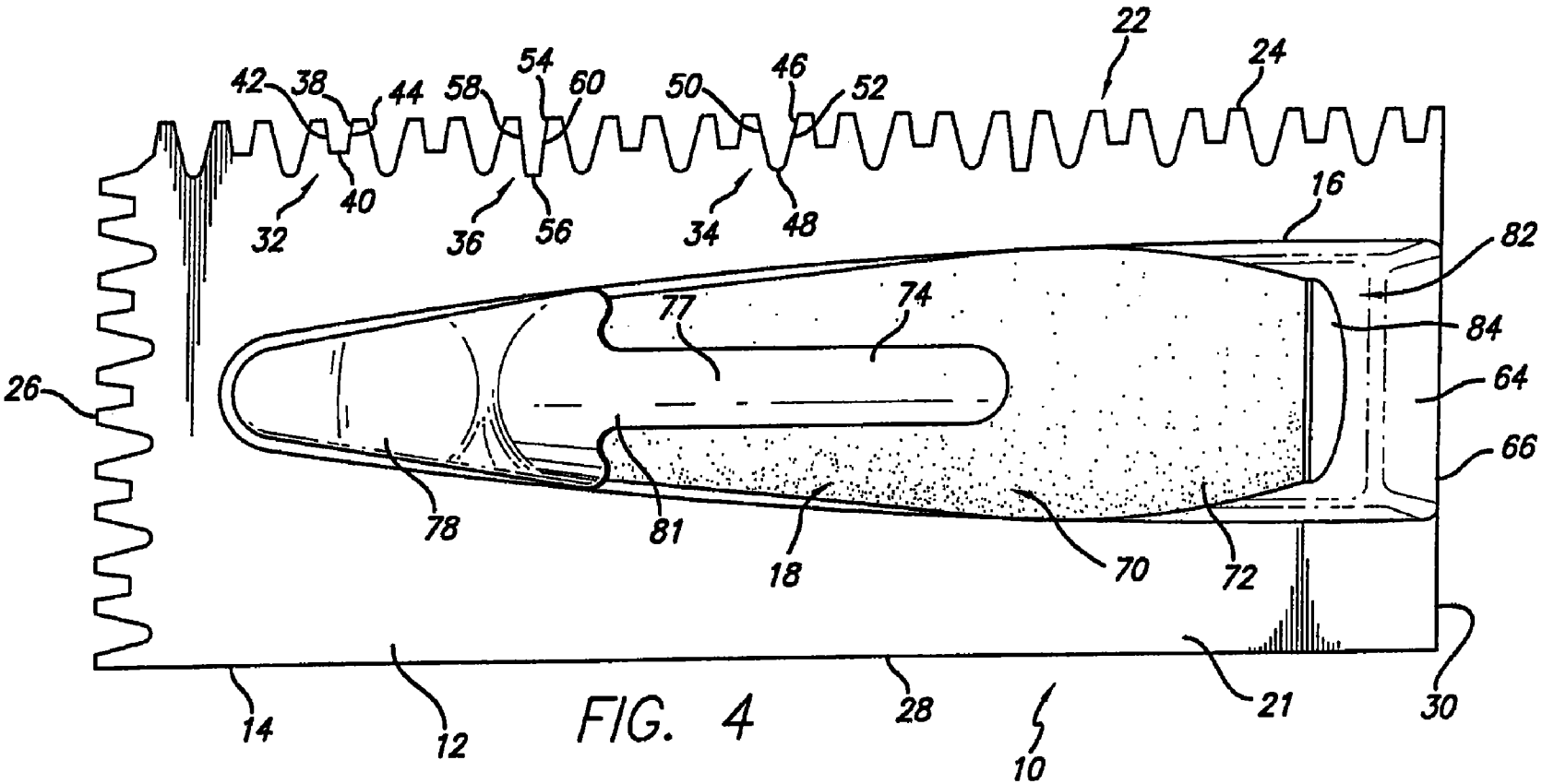
FIG. 4 is a top plan view of the combination wedge and notch trowel with reversible grip handle of FIG. 1, showing the complete notch pattern of the blade portion.

Referring to FIGS. 1-3, the notch trowel wedge member or shank has an elongated flattened rectangular wedge main body portion 62, a beveled wedge portion 64 tapering from the main body portion to a narrowed rear edge portion 66 abutting and coterminous with the short smooth side of the blade portion, so that the wedge member can be placed under an edge of a tile to be removed, and can be used to pry up the tile without bending or otherwise damaging the blade portion of the trowel. The wedge member is typically formed of hollow cast aluminum, but the wedge member may optionally be formed of solid metal. The wedge member can be mounted to blade portion by rivet plus adhesive, or by an adhesive film alone, such as an adhesive film available from 3M, although alternatively the wedge member may be mounted to the blade portion by bolts, rivets, welding, or the like.

In a presently preferred aspect, the ergonomic reversible grip handle is formed in the shape of a generally curving elongated cylindrical rigid member having a generally cylindrical main body 70 formed by a curving half cylindrical handle grip portion 72 which mates with a correspondingly curved half cylindrical handle support member 74, and a joint 76 interfacing between the grip portion and handle support member. The grip portion is typically formed of polyurethane, but can be formed from rubber, wood, metal or plastic, for example. The handle support member is typically formed of aluminum, but may be made of other suitable rigid materials, such as stainless steel, for example. In a presently preferred aspect, in order to allow the handle to be gripped more comfortably with either hand or in a forward or reversed position, the grip portion preferably extends over half of the length of the blade portion.

Figure 5:
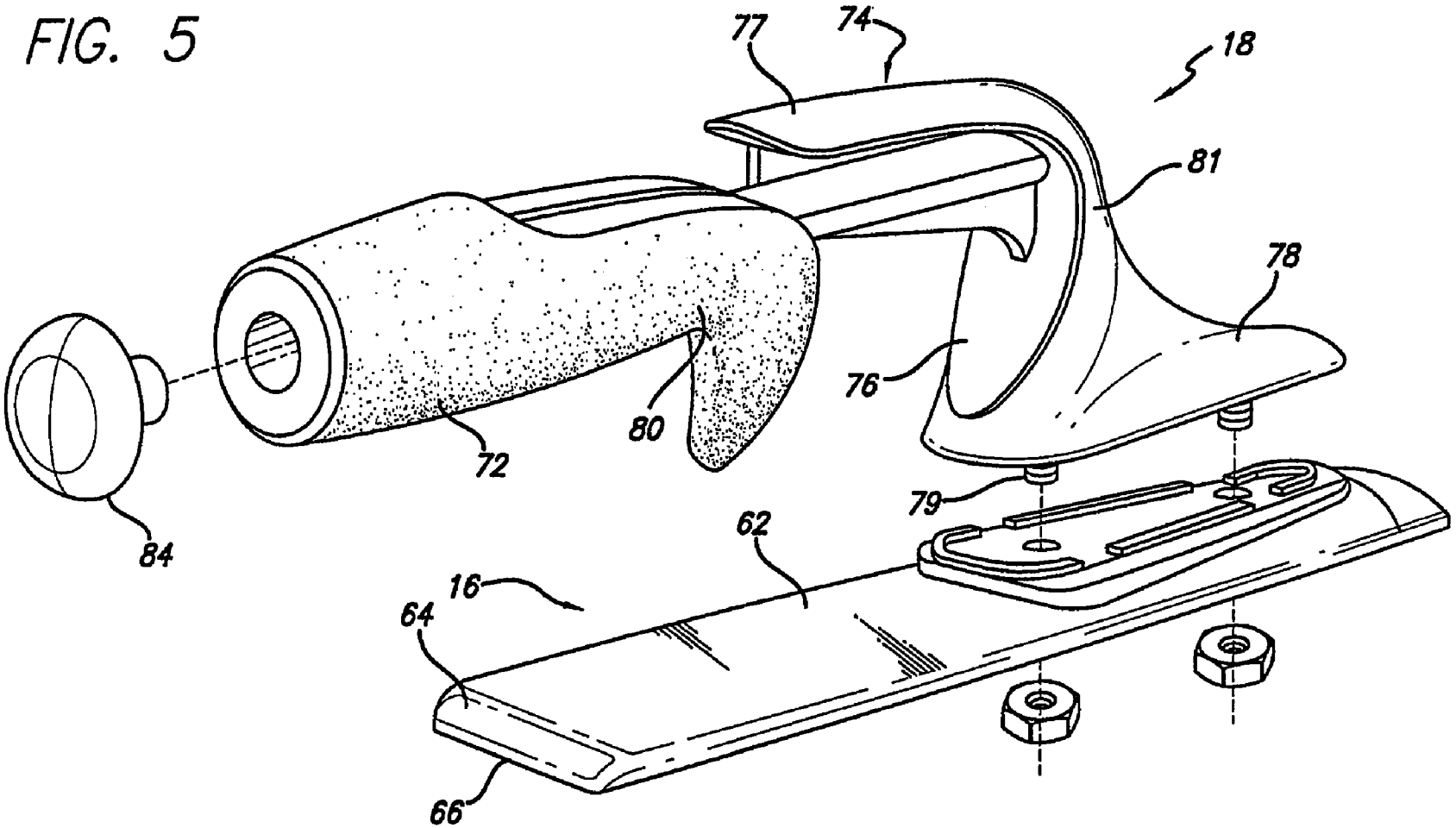
FIG. 5 is an exploded view of the combination wedge and notch trowel with reversible grip handle of FIG. 1.
Figure 6:
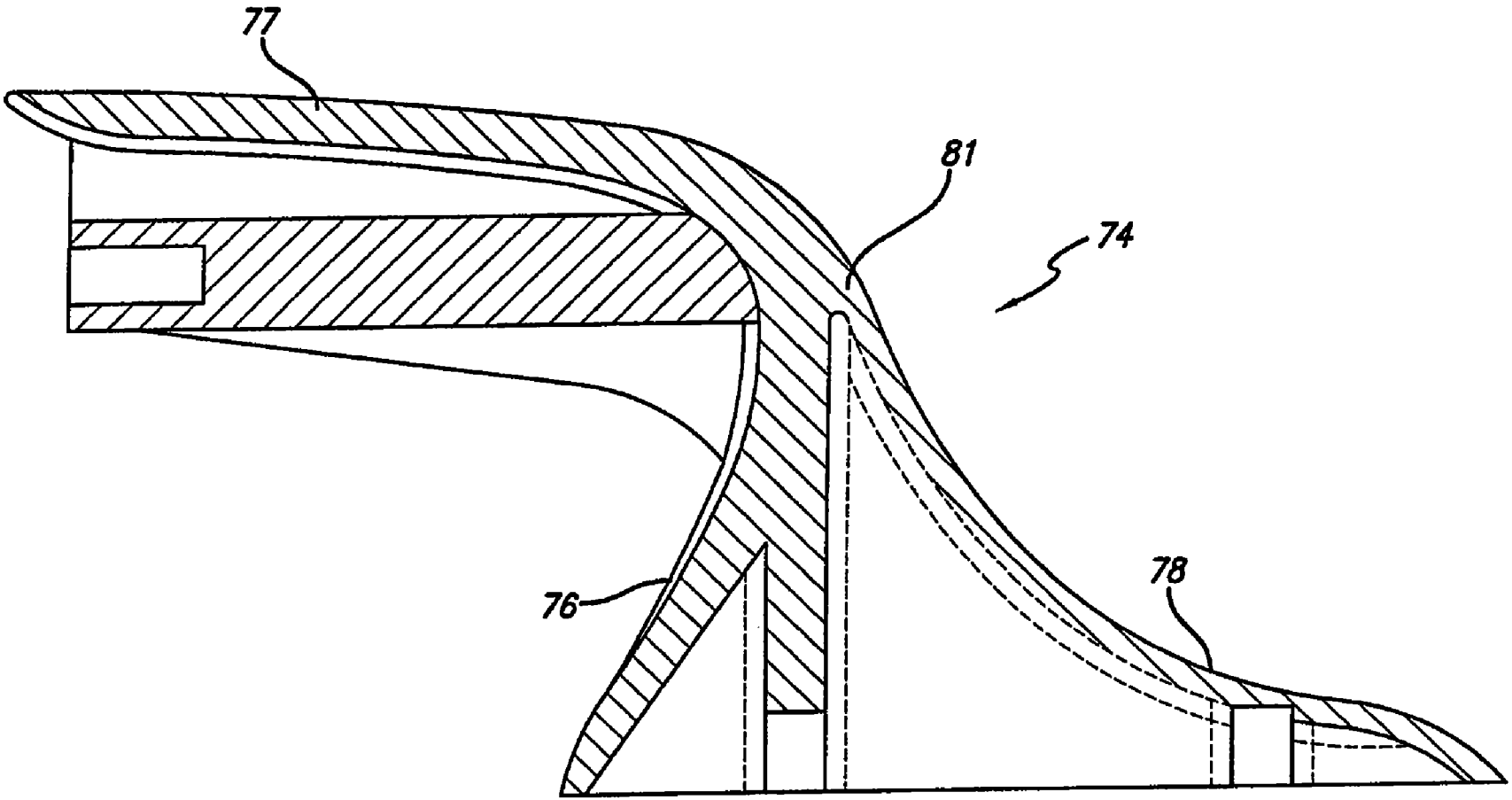
FIG. 6 is a side sectional view of the handle support member of the combination wedge and notch trowel with reversible grip handle of FIG. 1.

Referring to FIGS. 4-6, the handle support member typically has an S-shaped curved configuration with an upper support portion 77 connected to the grip portion, a middle neck portion 81 having a curvature tapering from the upper support portion to a base support portion 78 mounted to the blade portion, wherein the handle support member curves from the base support portion to extend over the wedge member toward the smooth side abutting the narrowed rear edge portion of the wedge member. The base support portion is typically flattened to be mounted to the blade portion, and typically has a rounded triangular shape. The base support portion may be mounted to the wedge member by bolts 79, welding, or adhesive, for example, adjacent to the short notched side of the blade portion. Alternatively, the base support portion may be mounted directly to the blade portion adjacent to the short notched side of the blade portion. The intermediate handle support member is preferably connected to the flattened base support portion at approximately a 90 degree angle, and curves from the flattened base support portion to extend toward the short smooth side over the wedge member.

The grip portion preferably includes a tapering neck portion 80 extending from the main body of the grip portion following a corresponding curvature of the handle support member and extending substantially perpendicular to the base support portion. The grip portion preferably widens from the handle support member, curving toward the rounded butt end 82 of the grip portion, typically formed by an end cap 84 which is mounted to the handle grip portion, such as by a bolt or otherwise threadedly securing the end cap to the handle support member to connect the handle support member and handle grip portion, which slides on to the handle support member. The shape of the ergonomic reversible grip handle allows the user to grip the handle with either hand, and reverse the direction of the handle in a user's hand.

It will be apparent from the foregoing that, while particular forms of the invention have been illustrated and described, various modifications can be made without departing from the spirit and scope of the invention. Accordingly, it is not intended that the invention be limited, except as by the appended claims.

The invention claimed is:

1. A notch trowel for spreading cement or adhesive over a substrate surface for the installation and removal of tiles, the notch trowel comprising:

a substantially rigid trowel blade portion having a flat bottom surface and a peripheral blade edge with a smooth side and a series of notches being formed in the peripheral blade edge along at least one other side of the blade edge;

a wedge member mounted to the blade portion, the wedge member having an elongated flattened rectangular wedge main body portion and a beveled wedge portion tapering from the main body portion to a narrowed rear edge portion abutting the smooth side of the peripheral blade edge, whereby the wedge member can be placed under an edge of a tile to be removed, and can be used to pry up the tile without bending or otherwise damaging the blade portion of the trowel; and an ergonomic reversible grip handle mounted to the blade portion for manually grasping and manipulating the notch trowel, the ergonomic reversible grip handle including a cylindrical main body formed by a grip portion and a handle support member, the handle support member having an S-shaped curved configuration with an upper support portion connected to the grip portion, a middle neck portion having a curvature tapering from the upper support portion to a base support portion connected to the wedge member, wherein the handle support member curves upwardly from the base support portion to the upper support portion, wherein the upper support portion extends parallel to and over said wedge member toward said smooth side abutting said narrowed rear edge portion of said wedge member.

2. The notch trowel of claim 1, wherein the wedge member is formed of hollow cast aluminum.

3. The notch trowel of claim 1, wherein the wedge member is mounted to blade portion by an adhesive.

4. The notch trowel of claim 1, wherein the handle comprises a base support portion mounted to the wedge member.

5. The notch trowel of claim 1, wherein the grip portion extends over half of the length of the blade.

6. The notch trowel of claim 1, wherein said ergonomic reversible grip handle comprises a joint interfacing between the grip portion and handle support member.

7. The notch trowel of claim 1, wherein the base support portion has a flattened, rounded triangular shape.

8. The notch trowel of claim 1, wherein said grip portion slides on to the handle support member.

9. The notch trowel of claim 1, wherein the grip portion comprises a rounded butt end.

10. The notch trowel of claim 1, wherein said ergonomic reversible grip handle comprises a rounded end cap.

11. A notch trowel for spreading cement or adhesive over a substrate surface for the installation of tiles on the substrate surface, the notch trowel comprising:

a substantially rigid trowel blade portion having a flat bottom surface and a peripheral blade edge with a smooth side and a plurality of notches formed in the peripheral blade edge along at least one other side of the blade edge;

a handle mounted to the blade portion for manually grasping and manipulating the notch trowel; and wherein said plurality of notches include a plurality of first short trapezoidal notches, a plurality of second large parabolic notches interspersed among said short trapezoidal notches extending into the blade edge to a greater depth than the first short trapezoidal notches, and a plurality of third intermediate size trapezoidal notches interspersed among said plurality of first short trapezoidal notches and said plurality of second large parabolic notches, and wherein said plurality of third intermediate size trapezoidal notches extend into the blade edge to a greater depth than the large parabolic notches.

12. The notch trowel of claim 11, wherein said plurality of first short trapezoidal notches, said plurality of second large parabolic notches, and said plurality of third intermediate size trapezoidal notches have conically configured first and second side edges that are oblique to a corresponding side of the blade edge.

13. The notch trowel of claim 11, wherein said plurality of second large parabolic notches have an open mouth portion and an opposing closed rounded end portion.

14. The notch trowel of claim 11, wherein said plurality of third intermediate size trapezoidal notches are smaller in area than the large parabolic notches.

15. The notch trowel of claim 14, wherein said plurality of first short trapezoidal notches and said plurality of third intermediate size trapezoidal notches have open mouth portions of equal size.

16. The notch trowel of claim 11, wherein said peripheral blade edge comprises a notched long side, an adjacent notched short side, a smooth long side opposing the notched long side, and a smooth short side opposing the notched short side.

17. The notch trowel of claim 16, wherein said handle comprises an ergonomic reversible grip handle.

* * * * *